United States Patent [19]

Tanaka

[11] 4,043,448

[45] Aug. 23, 1977

[54] CHILD-PROOF CONTAINER

[75] Inventor: Yoshinobu Tanaka, Toyonaka, Japan

[73] Assignee: Alpha Techno Company, Ibaraki, Japan

[21] Appl. No.: 698,995

[22] Filed: June 23, 1976

[30] Foreign Application Priority Data

June 24, 1975 Japan ..... 50-89414

[51] Int. Cl.[2] ..... B65D 43/16; B65D 55/02

[52] U.S. Cl. ..... 206/1.5; 220/260; 220/307; 220/281; 215/209; 220/339

[58] Field of Search ..... 215/209, 301; 206/1.5, 206/307; 220/260, 339, 281, 283

[56] References Cited

U.S. PATENT DOCUMENTS 3,907,103 9/1975 Shaw ..... 206/1.5

*Primary Examiner*—George T. Hall

*Attorney, Agent, or Firm*—Griffin, Branigan & Butler

[57] ABSTRACT

A child-proof container comprises a tubularly-shaped main housing formed of a resilient plastic having first and second end edges. A permanent bottom wall is integrally formed with the main housing adjacent the first end edge of the main housing but spaced slightly inwardly from the first end edge. A cover is hingedly attached at the opposite end of the main housing also spaced slightly inwardly from the second end edge of the main housing. An internal surface of the main housing includes a slot for receiving a free edge of the cover when the cover is in a closed position, the slot being also located slightly inwardly from the second end edge, and a "stop" located inwardly from the slot for engaging an inner surface of the cover to prevent further inward rotation of the cover. In one embodiment, the tubularly-shaped main housing has a circular cross section and in a second embodiment, it has a partially circular and partially flat shape. An embellishment of either of these embodiments includes a false or fake cover at the closed end of the main housing.

7 Claims, 6 Drawing Figures

CHILD-PROOF CONTAINER

BACKGROUND OF THE INVENTION

This invention relates to containers requiring sufficient intellect to open the covers or closures thereof to discourage children from gaining access to the containers.

So-called child-proof containers prevent infants and young children from putting dangerous medicaments, adhesives, and the like into their mouths, even though they get containers for these materials in their hands. Some such containers require a sufficiently high level of dexterity to open the covers thereof that young children cannot operate them, and some such containers deceive children by hiding or camouflaging the covers. This invention employs both of these concepts to some extent.

A major object of this invention is to provide plastic containers having covers which are difficult for young children to both find and open.

A second object of this invention is to provide containers having false covers so as to deceive young children into applying pressure to portions of the containers which do not grant access to the containers.

SUMMARY OF THE INVENTION

According to principles of this invention, a cover is provided for a resilient plastic container which is located inwardly from outer end edges of the container. It is difficult for a child to firstly recognize such a cover as being a cover and secondly to grip such a cover in the normal way for opening it. The cover is opened by squeezing the main housing of the container in a particular manner. The opposite end of the container is made to either resemble the cover end of the container or to have the appearance of a conventional cover.

BRIEF DESCRIPTION OF THE DRAWINGS

The foregoing and other objects, features, and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
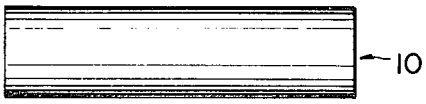
FIG. 1 is a side view of a first embodiment of this invention.
Figure 2:
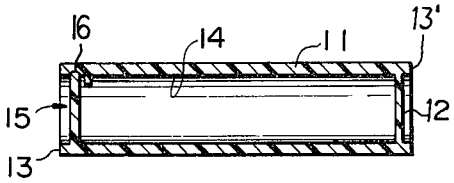
FIG. 2 is a longitudinal sectional view of the first embodiment of FIG. 1.
Figure 3:
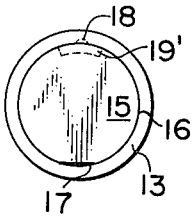
FIG. 3 is a side view taken from the left end of the embodiment of FIG. 1.
Figure 4:
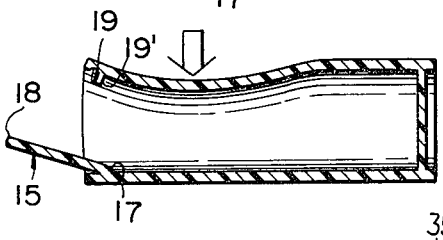
FIG. 4 is a sectional view similar to FIG. 2, but taken at a period of time when a cover thereof is being opened.
Figure 5:
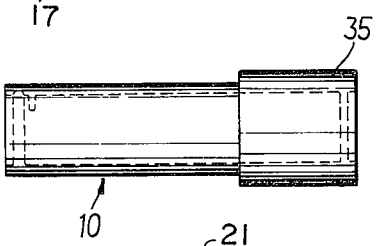
FIG. 5 is a side view of the embodiment of FIG. 1 but including the embellishment of a false cover.

In the first embodiment of the invention depicted in FIGS. 1–4 (when it is unembellished as in FIG. 5) a plastic container 10 has a configuration such that it is difficult from its appearance to ascertain where its cover is. In the embellishment of FIG. 5, ascertaining the location of the true cover is made even more difficult by the inclusion of a false cover 35.

More particularly, the plastic container 10 includes a tubularly-shaped main body 11 having a cylindrical shape as is depicted in FIG. 3. The main body 11 is formed of a resilient plastic which, when depressed, has a memory and returns to its former configuration upon release. The plastic container 10 further includes a bottom wall 12 integrally formed with the main body 11 and being connected to the main body 11 about the bottom wall's perimeter at a position spaced inwardly from the end edge 13' of the main body 11. The main body 11 includes an internal surface 14 and a top end edge 13.

A disc-shaped cover 15 is hingedly attached to the internal surface 14 of the main body 11 at the cover's outer edge 16. The cover's outer edge 16 is attached to the internal surface 14 in such a manner that the cover 15 and the main body 11 can be formed integrally to produce the hinged portion 17. In this respect, it is desirable that the hinged portion 17 be somewhat straight to form an arc line as is depicted in FIG. 3. It should be noted that the hinged portion 17 is spaced inwardly from the top end edge 13 of the main body 11. The cover 15 includes at its outer, free end a lug 18 extending from the cover's outer edge 16 and a complementary recess 19 is provided in the internal surface 14 of the main body 11 for receiving the lug 18. Again, the recess 19 is spaced inwardly from the top end edge 13 of the main body 11. In addition, a stop 19 is provided immediately inside the recess 19.

In operation, when a force is exerted by pushing downwardly on the main body 11 of the plastic container 10 at an arrow-directed spot (FIG. 4) with fingers, adjacent parts of the main body are curved to "open" the mouth at the recess 19. The lug 18 of the cover 15 is thereby sprung out of the recess 19. The cover 15 is caused to rotate outwardly as is shown in FIG. 4. To close the cover 15, the cover 15 is pushed inwardly so that the lug 18 enters the recess 19 and abutts against the stop 19'. Thus, the cover portion is fixed in position and fully closed.

It should be appreciated that small children who are less intelligent than adults and who are not taught how such a container is to be opened with hands, could not get under the cover 15 to open it. Usually, they try to open the container by pushing the bottom wall 12 or the cover 15 inwardly, neither of which opens the container. Finally, they give up trying to open the container. Although children have trouble opening this container, once adults are shown how to open it, it is relatively easy for them to open.

The first embodiment embellished as in FIG. 5 is essentially the same as shown in FIGS. 1–4 with the exception that a false cover 35 is formed on the plastic container 10 at the end of the container 10 opposite the true cover. In this respect, the false cover is merely an enlarged outer diameter of the main body 11 and shaped and colored in such a way as to resemble a screw-thread-type cover. Again, a child would be misled by the false cover and would exert his efforts in nonproductive activities.

Figure 6:
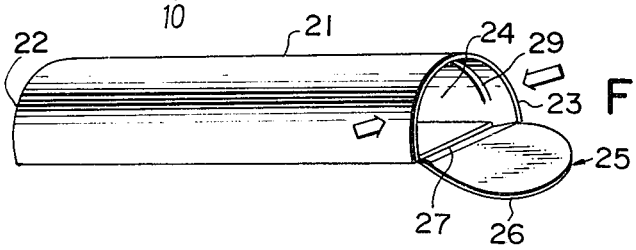
FIG. 6 is an isometric view of a second embodiment of this invention wherein a main housing of a container has a shape different from the shape of the container of the embodiment of the device of FIG. 1.

Looking finally at the embodiment of FIG. 6, this embodiment is also quite similar to the other described embodiments with the exception that a container main body 21 has a semicircular, or dome-shaped cross sectional shape with one flat side. Again, the main body 21 is formed of resilient plastic having a memory.

A groove 29 is formed in an interior surface 24 of the main body 21 adjacent to the top end edge 23, but spaced inwardly therefrom. A cover 25 is integrally formed on the main body 21 by a hinge portion 27. The cover 25 has a curved edge 26. Again, there is a stop similar to the stop 19' in the FIGS. 1–5 embodiment.

In operation, the cover 25 is closed by pushing it inwardly until the curved edge 26 is forced to fit into the groove 29. When it is desired to open the cover, pressure is applied this time to the sides of the main body 21 as is illustrated by arrows in FIG. 6. When this is done, the groove 29 disengages the curved edge 26 of the cover 25.

As in the case of the FIGS. 1–4 embodiment, in this embodiment it is advantageous to make the opposite ends of the main body 21 have identical appearances. In this respect, a bottom wall (not shown) is also spaced from a bottom end edge 22 in the same manner as the cover 25 is spaced from the top end edge 23.

Opening a container employing principles of this invention is uncomplicated but yet cannot be easily understood by children, even if they are given brief directions. Thus, there is substantial insurance that infants cannot get into such containers to gain access to harmful substances therein.

The embodiments of the invention in which an exclusive property or privilege are claimed are defined as follows:

I claim:

1. A container defining an opening, said container including an integral cover for covering said opening, and being difficult for children to both recognize and open, said container comprising:

a tubularly-shaped main housing formed of a resilient material having internal and external surfaces and first and second end edges;

a bottom wall integrally formed with said tubularly-shaped main housing adjacent said first end edge of said main housing, said bottom wall permanently closing a first end of said tubularly-shaped main housing by being integrally attached to said housing about the bottom wall's perimeter;

a cover integrally formed with said tubularly-shaped main housing adjacent said second end edge of said main housing, said cover being integrally attached to said tubularly-shaped main housing adjacent said second end edge thereof, but inwardly spaced from said second end edge, said attachment being along a portion only of the outer perimeter of said cover so as to form a hinge means inwardly spaced from said second end edge for allowing said cover to be selectively rotated between a closed position closing a second end of said main housing and an open position rotated outwardly from said main housing;

said internal surface of said tubularly-shaped main housing including a slot for receiving a free edge of said cover when said cover is in a closed position, said slot forming a shoulder located inwardly from said second end edge, for engaging an inner surface of said cover to prevent further inward rotation of said cover from said closed position such that an outer surface of said cover is spaced inwardly from said second end edge of said tubular main housing when said cover is in said closed position.

2. A container as claimed in claim 1 wherein said tubularly-shaped main housing has a circular cross section.

3. A container as claimed in claim 2 wherein said bottom wall is spaced inwardly from said first end edge in approximately the same manner as said cover is spaced inwardly from said second end edge.

4. A container as claimed in claim 2 wherein said tubularly-shaped main housing has an external surface at its first end having the appearance of a conventional cover.

5. A container as claimed in claim 1 wherein said tubularly-shaped main housing has a partially circular cross section with one straight side.

6. A container as in claim 5 wherein said bottom wall is spaced inwardly from said first end edge in approximately the same manner as said cover is spaced from said second edge.

7. A container as in claim 1 wherein said tubularly-shaped main housing has an external surface at its first end having the appearance of a conventional cover.

* * * * *